US006311158B1

(12) United States Patent
Laroche

(10) Patent No.: US 6,311,158 B1
(45) Date of Patent: Oct. 30, 2001

(54) SYNTHESIS OF TIME-DOMAIN SIGNALS USING NON-OVERLAPPING TRANSFORMS

(75) Inventor: Jean Laroche, Santa Cruz, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/268,878

(22) Filed: Mar. 16, 1999

(51) Int. Cl.[7] ..... G10L 13/04
(52) U.S. Cl. ..... 704/269; 704/268
(58) Field of Search ..... 704/266–269; 700/94; 84/623, 624

(56) References Cited

U.S. PATENT DOCUMENTS

| | | | | |
|---|---|---|---|---|
| 3,588,353 | * | 6/1971 | Martin | 704/268 |
| 4,231,277 | * | 11/1980 | Wachi | 84/605 |
| 4,885,790 | * | 12/1989 | McAulay | 704/265 |
| 5,401,897 | * | 3/1995 | Depalle et al. | 84/625 |
| 5,536,902 | * | 7/1996 | Serra et al. | 84/623 |
| 5,787,387 | * | 7/1998 | Aguilar | 704/268 |
| 5,832,437 | * | 11/1998 | Nishiguchi et al. | 704/268 |

OTHER PUBLICATIONS

Griffin, Daniel W. and Jae S. Lim, "Signal Estimation from Modified Short–Time Fourier Transform," IEEE trans. Acoust., Speech, and Sig. Proc. vol. ASSP–32, No. 2, Apr. 1984, pp. 236–243.*

* cited by examiner

*Primary Examiner*—William Korzuch
*Assistant Examiner*—Donald L. Storm
(74) *Attorney, Agent, or Firm*—Townsend and Townsend and Crew LLP

(57) ABSTRACT

Techniques for synthesizing a time-domain signal. The time-domain signal is partitioned into a number of time-domain frames and a waveform in generated for each time-domain frame. Each waveform includes one or more sinusoids. The waveform is generated by selecting a sinusoid for synthesis and computing a set of parameter values (e.g. the start and end amplitude, frequency, and phase values) for the selected sinusoid. A template is determined for the selected sinusoid based on the computed parameter values and a selected window function. The frequency-domain template is such that the amplitude of the selected sinusoid in the time domain matches, at a time-domain frame boundary, the amplitude of a corresponding sinusoid in an adjacent time-domain frame. The template is added to a frequency-domain frame. The process is repeated for each sinusoid in the waveform. After all sinusoids have been processed, the frequency-domain frame is transformed to a time-domain frame. The time-domain frame is re-normalized with a re-normalization function that is generated based on the selected window function. A predetermined number of samples from each end of the time-domain frame can be discarded. The waveform is defined by the non-discarded samples in the time-domain frame. The waveforms from the time-domain frames are concatenated to generate the time-domain signal.

28 Claims, 5 Drawing Sheets

SYNTHESIS OF TIME-DOMAIN SIGNALS USING NON-OVERLAPPING TRANSFORMS

BACKGROUND OF THE INVENTION

The present invention relates generally to signal processing, and more particularly to techniques for synthesizing time-domain signals by use of non-overlapping inverse Fourier transforms.

Sinusoids are fundamental building blocks used in the synthesis of waveforms for speech, audio, music, and other applications. It is known that a particular time domain signal can be decomposed into a sum of sinusoids, with each sinusoid having a particular amplitude, frequency, and phase. In fact, a time-domain signal can be fully represented by its corresponding frequency-domain spectrum.

In sinusoidal modeling or additive synthesis of speech, audio, or music signal, it is often necessary to synthesize and sum a large number of sinusoids with time-varying amplitude, frequency, and phase parameters. For example, an accurate representation of a low piano note can require over 100 sinusoids. Several techniques currently exist for the synthesis of sinusoids, including) wavetable synthesis and synthesis using overlapping Fourier transforms.

Wavetable synthesis is a popular technique for synthesizing waveforms. A wavetable synthesizer typically stores samples of a limited number of representative waveforms in a read-only memory (ROM) that are later retrieved and manipulated to generate the desired waveform. For example, a music wavetable synthesizer implementing a piano may store a set of representative notes (i.e., eight notes out of eighty-plus possible notes the piano is capable of playing). To synthesize a desired note, one of the representative notes is retrieved from memory, shifted in pitch to match that of the desired note, and converted to a desired output format (e.g., an analog signal). As can be seen, the cost to implement a wavetable synthesizer can be very high when large numbers of sinusoids need to be synthesized. Further, the need to determine and store representative waveforms can limit the use of the wavetable synthesizer to specific applications. Wavetable synthesizer is further described in U.S. Pat. No. 5,809,342.

Synthesis using overlapping inverse Fourier transforms is another technique for synthesizing waveforms. In this technique, the signal to be synthesized is partitioned into overlapping frames, with each frame including a number of samples from preceding and succeeding frames. The overlapping attempts to minimize the amount of discontinuity at the frame boundary. The signal is then synthesized frame by frame. Each frame typically includes a number of sinusoids, with each sinusoid corresponding to a "peak" in the frequency domain. For each frame, a peak is synthesized in the frequency domain for each of the sinusoids. The peaks in the frame are added together and an inverse Fourier transform is calculated to generate a time-domain frame. Consecutive time-domain frames are synthesized in the above-described manner, overlapped with adjacent frames, and added together with these frames. This technique is further described in U.S. Pat. No. 5,401,897.

The use of inverse Fourier transforms that overlap results in additional cost and can generate artifacts that degrade performance. For example, for implementations having fifty percent overlapping, half of the samples in any particular frame is from the preceding frame and the remaining half of the samples is from the succeeding frame. Overlapping the frames thus results in more frames being calculated per second of output signal. Moreover, it has been noted that artifacts can occur in the overlapping regions whenever the frequency of the sinusoids changes from one frame to the next, which commonly occurs. The artifacts include undesirable amplitude modulation that arises from summing sinusoids from adjacent frames having similar, but different frequencies. To counter this undesirable modulation, sweeping sinusoids can be generated such that the frequency of these sinusoids varies linearly (i.e., instead of being constant) within a particular frame or exhibits two sweep rates within one frame. The generation of sweeping sinusoids can significantly complicate the synthesis process and typically requires additional computations.

Thus, techniques that efficiently synthesize time-domain signals with reduced complexity and minimal amounts of artifacts are highly desirable.

SUMMARY OF THE INVENTION

The invention provides techniques for synthesizing time-domain signals using less computations and having improved signal quality. The synthesis is achieved using non-overlapping Fourier transforms. The time-domain signal is decomposed to a series of waveforms, with each waveform being generated by a sum of sinusoids. Each sinusoid is synthesized by a spectral pattern in the frequency domain that corresponds to a selected (e.g., Hanning) window function. Discontinuities in the amplitude and phase of adjacent waveforms are minimized by matching the amplitude and phase of pairs of corresponding sinusoids in adjacent frames. Matching of amplitude and phase can be achieved by synthesizing sinusoids with linearly varying amplitude and phase.

An embodiment of the invention provides a method for synthesizing a time-domain signal. In accordance with the method, the time-domain signal is partitioned into a number of time-domain frames and a waveform is then generated for each time-domain frame. Each waveform includes one or more sinusoids. The waveform is generated by first selecting a sinusoid for synthesis. A set of parameter values (e.g., the start and end amplitude, frequency, and phase values) is computed for the selected sinusoid. A template is then determined for the selected sinusoid and added to a frequency-domain frame. The template is based on the computed parameter values and a selected window function. The process can be repeated for each sinusoid in the waveform. After all sinusoids have been processed, the frequency-domain frame is transformed to a time-domain frame. In an implementation, the time-domain frame is re-normalized with a re-normalization function that is generated based on (i.e., the inverse of) the selected window function. A predetermined number of samples from each end of the time-domain frame can be discarded. The waveform is defined by the non-discarded samples in the time-domain frame. The waveforms from the time-domain frames are concatenated to generate the time-domain signal.

Various additional features can be provided. For example, the selected window function can be oversampled to provide higher frequency resolution. The template typically includes a component corresponding to a sinusoid having constant amplitude and a component corresponding to a sinusoid having amplitude that varies linearly across the frame.

Another embodiment of the invention provides for a computer program product that implements the method described above.

Yet another embodiment of the invention provides for a signal synthesizer that includes an electronic storage unit and a processor. The electronic storage unit is configured to store values of a spectral pattern corresponding to a sinusoid. The processor couples to the electronic storage unit and is configured to generate a sequence of non-overlapping waveforms. Each waveform corresponds to a time-domain frame and includes one or more sinusoids. Each sinusoid is synthesized by placement of a template at a particular amplitude value and frequency corresponding to the sinusoid being synthesized.

The foregoing, together with other aspects of this invention, will become more apparent when referring to the following specification, claims, and accompanying drawings.

DESCRIPTION OF THE SPECIFIC EMBODIMENTS

Figure 1:
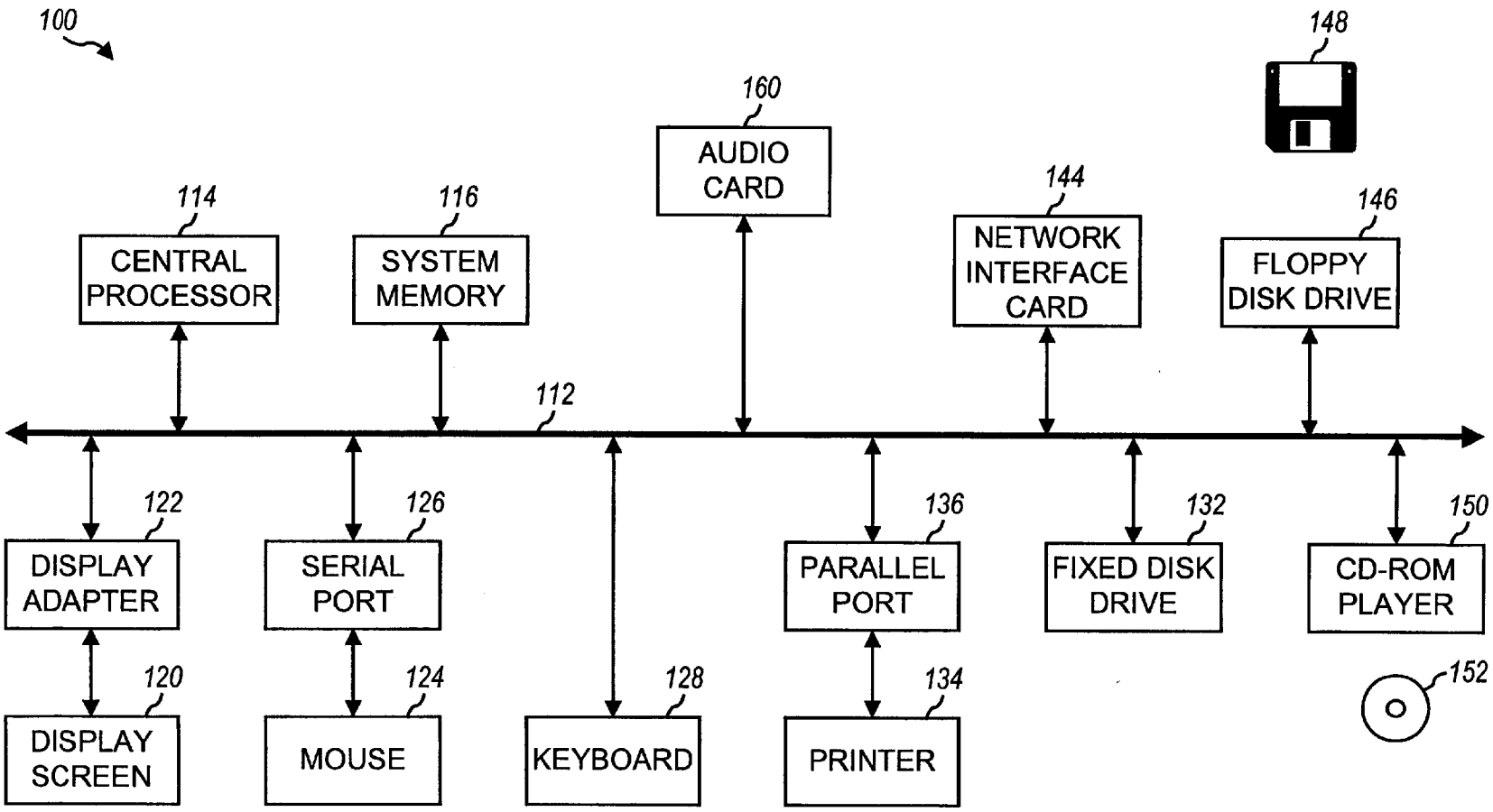
FIG. 1 shows the basic subsystems of a computer system suitable for implementing some embodiments of the invention.

FIG. 1 shows the basic subsystems of a computer system 100 suitable for implementing some embodiments of the invention. In FIG. 1, computer system 100 includes a bus 112 that interconnects major subsystems such as a central processor 114 and a system memory 116. Bus 112 further interconnects other devices such as a display screen 120 via a display adapter 122, a mouse 124 via a serial port 126, a keyboard 128, a fixed disk drive 132, a printer 134 via a parallel port 136, a network interface card 144, a floppy disk drive 146 operative to receive a floppy disk 148, a CD-ROM drive 150 operative to receive a CD-ROM 152, and an audio card 160. Source code to implement some embodiments of the invention may be operatively disposed in system memory 116, located in a subsystem that couples to bus 112 (e.g., audio card 160), or stored on storage media such as fixed disk drive 132, floppy disk 148, or CD-ROM 152.

Many other devices or subsystems (not shown) can be also be coupled to bus 112, such as an audio decoder, a sound card, and others. Also, it is not necessary for all of the devices shown in FIG. 1 to be present to practice the present invention. Moreover, the devices and subsystems may be interconnected in different configurations than that shown in FIG. 1. The operation of a computer system such as that shown in FIG. 1 is readily known in the art and is not discussed in detail herein.

Bus 112 can be implemented in various manners. For example, bus 112 can be implemented as a local bus, a serial bus, a parallel port, or an expansion bus (e.g., ADB, SCSI, ISA, EISA, MCA, NuBus, PCI, or other bus architectures). Bus 112 provides high data transfer capability (i.e., through multiple parallel data lines). System memory 116 can be a random-access memory (RAM), a dynamic RAM (DRAM), a read-only-memory (ROM), or other memory technologies.

In the invention, a time-domain signal is partitioned into a sequence of waveforms and synthesized waveform by waveform. Each waveform is generated by a time-domain frame and covers a predetermined time period (i.e., includes a predetermined number of samples). The time-domain frame includes a number of sinusoids that define the waveform within that frame. Each sinusoid in the frame is synthesized by generating a "peak" in the frequency domain having an amplitude value and a frequency corresponding to the particular sinusoid being synthesized. The peak is a spectral pattern (i.e., a frequency-domain waveform) that corresponds to a selected window function, as described below. Starting with an initialized (i.e., blank) frequency-domain frame, the peaks for all sinusoids in the frame are generated and summed. The frequency-domain frame is then transformed to time domain by performing an inverse Fourier transform, a Fast Fourier Transform, a discrete cosine transform, or other transforms.

The resultant time-domain frame can be "re-normalized" to account for the use of the spectral pattern in the synthesis of the sinusoid. A predetermined number of samples at both ends of the frame can be discarded. The non-discarded portion of the frame is concatenated with the non-discarded portions of the preceding frame. The concatenated frames form the synthesized time-domain signal. Thus, each time-domain frame includes a waveform, and the concatenation of a series of waveforms forms the time-domain signal.

To minimize artifacts generated by processing a time-domain signal in discrete frames, the invention provides techniques to "match" the amplitude and phase of the waveforms at the boundary of adjacent frames. In particular, a waveform's amplitude and phase at the end of one frame is matched to another waveform's amplitude and phase at the start of the immediately succeeding frame. This matching minimizes discontinuity at the frame boundary, which causes artifacts in the synthesized time-domain signal. Specific techniques to ensure amplitude and phase matching are described below.

The length of each frame, in samples, is denoted by N. Although not a requirement, N is typically a power of two so that fast Fourier transforms (FFTs) can be used to efficiently transform frequency-domain frames to time-domain frames.

Each sinusoid in a time-domain frame corresponds to a peak in the frequency-domain frame. The shape of the peak is referred to as a "spectral pattern", or a frequency-domain waveform. In an embodiment, the spectral pattern, denoted as H(k), is obtained as the Fourier transform of a time-domain window function h(n) in accordance with the following:

$$H(k) = \sum_{n=-N/2}^{N/2} h(n) \cdot e^{\left(-j2\pi \frac{kn}{SN}\right)}, \qquad \text{Eq. (1)}$$

where S is an oversampling ratio for H(k). The frequency resolution of the frequency-domain frame is $$\frac{1}{NT_s}$$

where $T_s$ is the sampling period. By oversampling H(k) by a factor of S, a higher frequency resolution $$\left(i.e., \frac{1}{SNT_s}\right)$$

is achieved, which can translate to a synthesized time-domain signal having improved accuracy or greater signal fidelity, or both. S is an integer equal to one or greater, and is typically selected as a power of two (e.g., 2, 4, 8, 16, 32, 64, 128, and so on). A higher oversampling ratio S generally corresponds to improved signal synthesis but also results in a larger memory requirement to store H(k). In a specific embodiment, S is equal to 16.

The time-domain window function h(n) can be selected from window functions known in the art such as Hanning, Hamming, Kaiser, Gaussian, Dolph-Tchebyshev, Kaiser-Bessel, Blackman-Harris, triangular, rectangular, and other window functions. Window functions are described in detail by Frederic J. Harris in a technical paper entitled "Trigonometric Transforms—a Unique Introduction to the FFT," published August 1981 by Scientific-Atlanta Corporation (Technical Publication DSP-005 (8-81)), and incorporated herein by reference. The window function h(n) is used to generate a spectral pattern having a narrow width such that fewer points are needed to synthesize a sinusoid.

It can be noted that many windows are real (i.e., the imaginary part is zero) and symmetrical about a vertical axis (also referred to as even symmetry). Thus, the spectral pattern H(k) of the window function is also real and even symmetric. In an embodiment, a particular window function h(n) is selected and its spectral pattern H(k) computed once and stored as a table in a memory. For many window functions, such as the named window functions listed above, H(k) becomes very small for large values of k. Thus, only a limited number of values is stored for H(k). In an embodiment, KS values are stored for H(k), with $0 \leqq k \leqq KS$. If H(k) is an even symmetric function, H(−k)=H(k) and the values for −k do not need to be stored. The parameters K and S determine the size of the table. In an embodiment, K=6 and S=32, although other values can be used for K and S.

Figure 2:
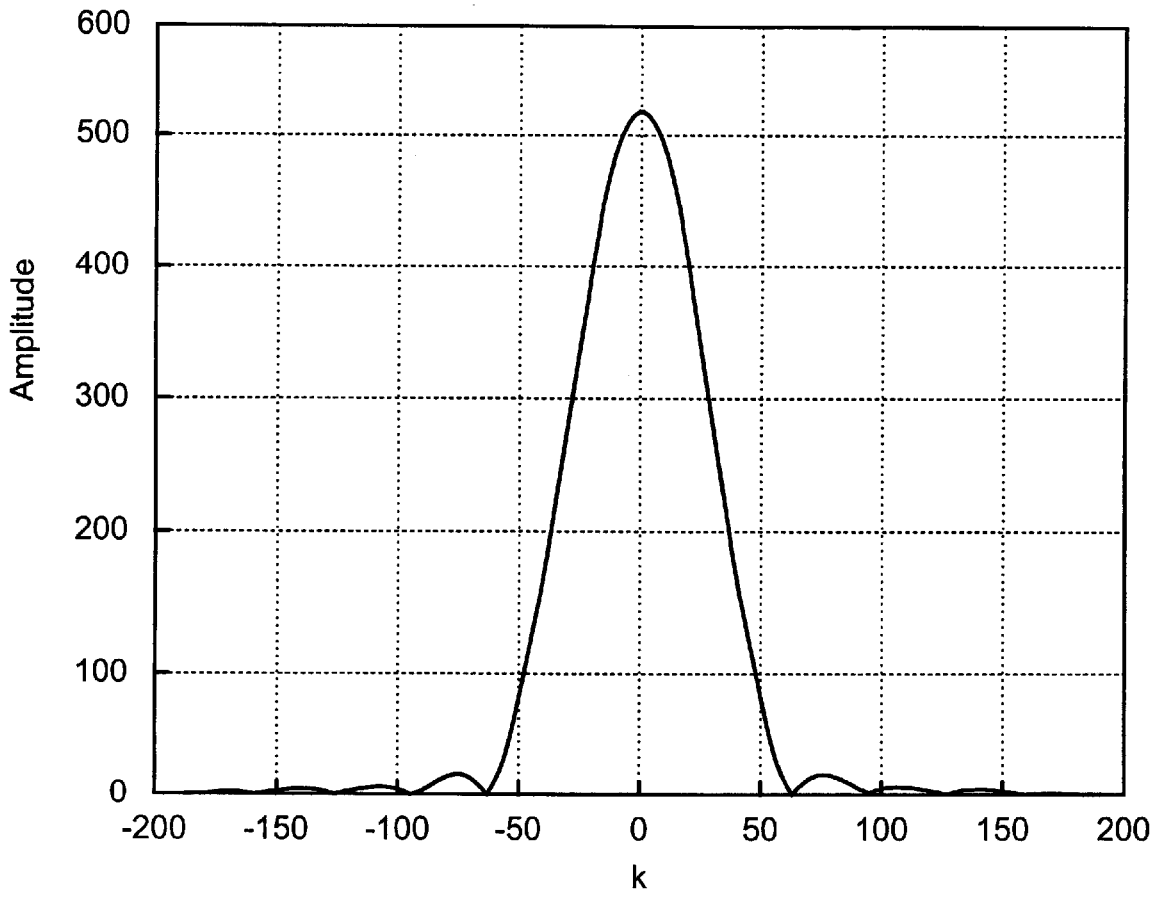
FIG. 2 shows a plot of a spectral pattern $H_h(k)$ of a specific window function.

FIG. 2 shows a plot of a spectral pattern $H_h(k)$ of a specific window function. The spectral pattern shown in FIG. 2 corresponds to a Hanning window function $h_h(n)$, which is defined as:

$$h_h(n) = 0.5 + 0.5\cos\left(\frac{2\pi n}{N}\right). \qquad \text{Eq. (2)}$$

The spectral pattern $H_h(k)$ in FIG. 2 is computed with N=1024, S=16, and K=6, and is shown as an example. Other spectral patterns can be used and are within the scope of the invention.

In an embodiment, the sinusoids within a frame are synthesized with amplitudes that vary (if at all) linearly across the frame. The amplitude of a sinusoid at a particular frequency can (and typically does) vary from one frame to the next. If a sinusoid is synthesized at one amplitude value in a first frame and another amplitude value in a succeeding frame, any difference in amplitude values generates a discontinuity at the frame boundary. In this embodiment, by linearly varying the amplitude of the sinusoid across the frame, the amplitude value at the frame boundary can be controlled and matched such that discontinuity is minimized (or possibly eliminated).

A sinusoid with linearly varying amplitude can be synthesized by a component related to the derivative of the spectral pattern H(k). The derivative of the spectral pattern in the frequency domain, denotes as H'(k), can be obtained as follows:

$$H'(k) = \frac{M}{2\pi}(H(k) - (H(k-1)), \qquad \text{Eq. (3)}$$

In an embodiment, H'(k) is computed once and stored in a table, along with H(k). Again, as with H(k), only a limited number of values is stored for H'(k) because H'(k) also becomes small for large values of k. If H(k) is even symmetrical, H'(k) is odd symmetrical and H'(−k)=−H'(k).

The waveform in each time-domain frame comprises the sum of a set of sinusoids, with each sinusoid having a particular amplitude and phase. A frequency-domain frame, denoted as X(k), is the frequency-domain representation of the time-domain frame and comprises the sum of a set of peaks having amplitudes and phases corresponding to those of the sinusoids. X(k) is generally a complex array having frequency-domain samples that include real and imaginary components. X(k) is initialized to zero for all values of k (i.e., $0 \leqq k \leqq (N-1)$) prior to the synthesis of the frame.

For a particular frame, each sinusoid in the frame is defined by its: (1) amplitude $A_s$ at the start of the frame (i.e., at time $t_s$ in FIG. 4), (2) amplitude $A_e$ at the end of the frame (i.e., at time te in FIG. 4), (3) phase $\phi_c$ at the center of the frame, and (4) frequency $\omega_o$ expressed in radian and ranging between 0 and $\pi$. With these parameters defined, the spectral pattern H(k) and the derivative of the spectral pattern H'(k) can be computed for that sinusoid and added to the frequency-domain frame X(k). In the embodiment wherein H(k) and H'(k) are precomputed, sampled, and stored in a table, H(k) and H'(k) are translated to a frequency bin $b_o$ that most closely approximates the actual frequency $\omega_o$ of the sinusoid. The bin $b_o$ is defined by the following:

$$\omega = \frac{2\pi b_o}{SN}. \qquad \text{Eq. (4)}$$

It can be noted that $b_o$ has a frequency resolution of H(k), which is.

$$\frac{1}{SNT_s}.$$

A sinusoid having an amplitude that varies linearly across a frame can be generated by (or decomposed into) a sum of a first sinusoid having a constant amplitude and a second sinusoid having (only) linearly varying amplitude. The constant amplitude sinusoid has an amplitude of A, where A is computed as:

$$A = \frac{(A_e + A_s)}{2}. \qquad \text{Eq. (5)}$$

The second sinusoid has an amplitude slope (or coefficient) a, where a is computed as:

$$\alpha = \frac{(A_e - A_s)}{(N - 2D)}, \qquad \text{Eq. (6)}$$

where D represents the portion being discarded from each end of the frame. Generally, a larger discarded portion (i.e., larger D) corresponds to greater accuracy in the synthesized time-domain signal. However, a larger discarded portion also results in more computations since a larger percentage of the frame is discarded. In an embodiment, D is approximately equal to N/10, although other values can be used for D and are within the scope of the invention. For example, D can be equal to zero, in which case no samples are discarded from the time-domain frame.

A composite spectral pattern, also referred to as a template, $H_t(k)$ can be computed for each sinusoid in the frame as:

$$H_t(k) = \left(\frac{A}{2} H(k) + j\alpha H'(k)\right) \cdot e^{(j\phi)}. \quad \text{Eq. (7)}$$

This template is centered at the frequency bin corresponding to the frequency of the sinusoid and added to the frequency-domain frame X(k). To achieve this, the center frequency bin $b_c$ is computed as:

$$b_c = \text{round}\left(\frac{b_0}{S}\right), \quad \text{Eq. (8)}$$

where round (β) denotes the integer closest to the real value of β. It can be noted that $b_c$ has a frequency resolution of X(k), which is $$\frac{1}{NT_s}.$$

The template $H_t(k)$ for the current sinusoid being synthesized is added to the frequency-domain frame X(k) as follows:

$$X(b_c+k)=X(b_c+k)+H_t(kS-(b_o-b_cS)), \text{ for } -K \leqq k \leqq K \quad \text{Eq. (9)}$$

In equation (9), the $X(b_c+k)$ term on the right hand side of the equality represents the "current" frequency-domain frame and the $X(b_c+k)$ term on the left hand side of the equality represents the "updated" frequency-domain frame. The template is translated to (or centered about) the approximated frequency $b_c$ of the sinusoid, as denoted by the indexing in $X(b_c+k)$. As described above, $H_t(k)$ is oversampled by S and has a frequency resolution that is more fine (if S>1) than that of X(k). Thus, every S-th sample of the template, as denoted by the indexing in $H_t(kS)$, is selected and added to $X(b_c+k)$. The factor $(b_o-b_cS)$ represents an offset value that accounts for error in the approximation of the center frequency $b_c$ due to quantization of $b_o$ performed in equation (8). This offset factor effectively increases the frequency resolution of X(k) by a factor of S.

Figure 3:
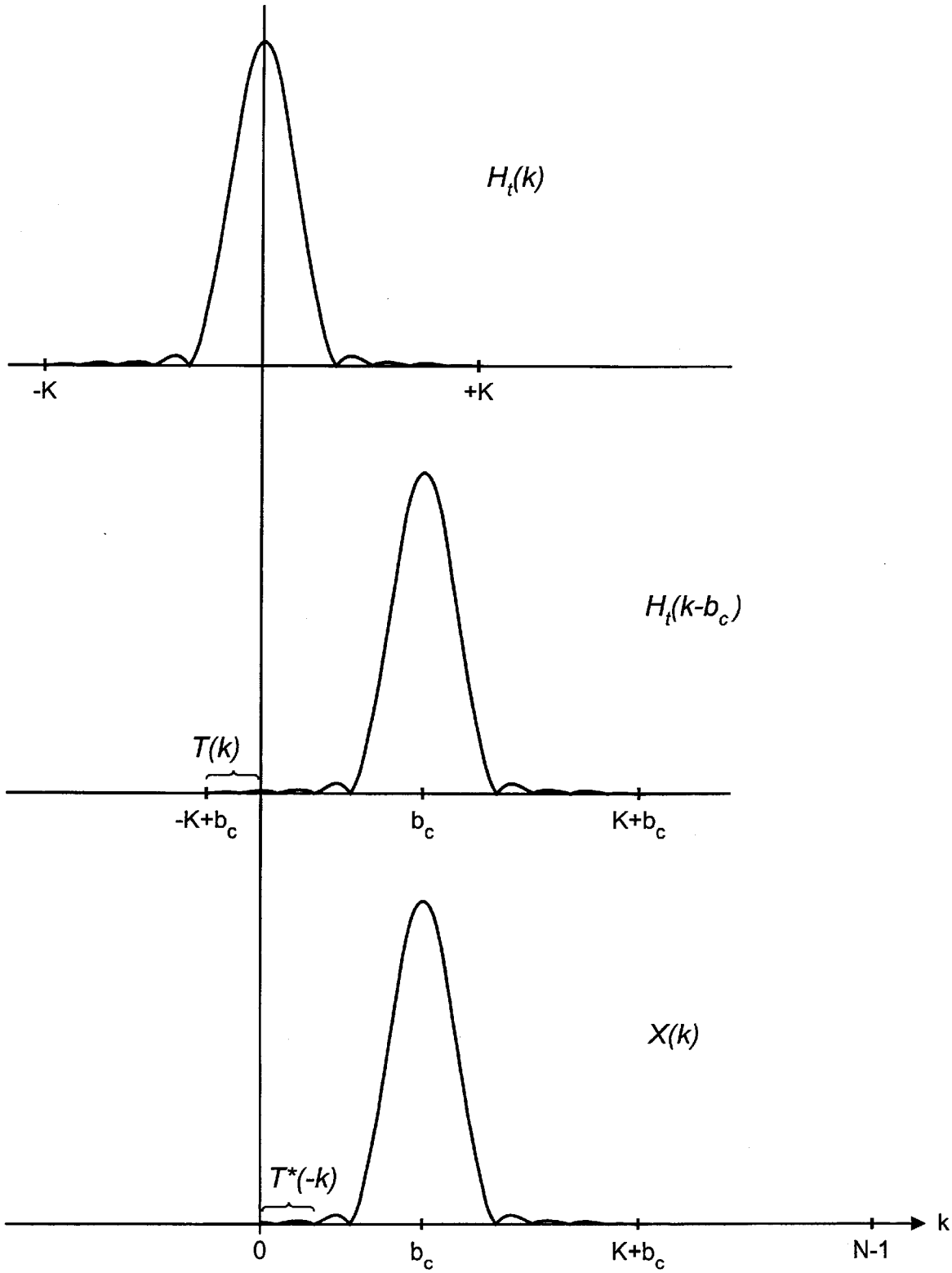
FIG. 3 shows a graph that illustrates the summation of negative frequency components of a template to a frequency-domain frame.

FIG. 3 shows a graph that illustrates the summation of negative frequency components of a template to the frequency-domain frame. A shown in FIG. 3 and equation (9), $H_t(k)$ is defined for k within the range of −K to K. If $H_t(k)$ is translated to a frequency bin $k_c$ that is less than K, a portion of the left tail of $H_t(k)$, denoted as T(k), effectively sits in negative frequency bins. In an embodiment, the negative frequency portion is reflected about the k=0 axis and the portion T(k) is "reflected" to the positive frequency bins and added to X(k) after a complex conjugation. As an example, the template value at k=−3, or $H_t(-3)$, is reflected back to k=+3 and added to the template value $H_t(+3)$.

The reflection about the k=0 axis is due to the specific embodiment described herein for synthesizing a sinusoid. For each real sinusoid, one peak exists in the positive frequency bins and another peak exists in the negative frequency bins. In the embodiment wherein only the peak in the positive frequency bins is synthesized, a peak centered about a low positive frequency bin spills into the negative frequencies (as shown by the plot for $H_t(k-b_c)$ in FIG. 3). Similarly, a peak centered about a low negative frequency bin spills into the positive frequencies. The portion of $H_t(k-b_c)$ in the negative frequencies that is reflected, or T*(−k), represents the portion of the peak centered about the negative frequency bin that spills into the positive frequencies.

If the approximated frequency $b_c$<K, the frequency-domain frame X(k) is computed as follows:

$$\begin{cases} X(b_c-k) = X(b_c-k) + H_t^*(kS-(b_o-b_cS)) & \text{for } -K \leq k < -b_c \\ X(0) = X(0) + 2\mathcal{R}(H_t(-b_o)) & \text{for } k = -b_c \\ X(b_c+k) = X(b_c+k) + H_t(kS-(b_o-b_cS)) & \text{for } -b_c < k \leq K \end{cases} \quad \text{Eq. (10)}$$

where $H_t^*(k)$ denotes the complex conjugate of $H_t(k)$ and $\mathfrak{R}(\beta)$ denotes the real part of a complex β. The conjugation of $H_t(k)$ allows for a synthesized time-domain signal that is real (i.e., having no imaginary component).

Equations (4) through (8) and either (9) or (10) are repeated for each sinusoid to be synthesized in the frame. Once the peaks corresponding to all sinusoids have been added into X(k), an inverse Fourier transform is performed to obtain a time-domain representation x(n). Generally, x(n) has the same length as X(k) and is valid for $0 \leqq n \leqq (N-1)$. Since a window function H(k) is used to synthesize the peaks in the frequency domain, x(n) is "re-normalized" by multiplication with a re-normalizing function g(n) as follows:

$$x_o(n)=x(n)\bullet g(n), \quad \text{Eq. (11)}$$

where g(n) is the inverse of the selected time-domain window function h(n) and is computed as:

$$g(n) = \frac{1}{h(n)}. \quad \text{Eq. (12)}$$

The re-normalization corrects for "distortion" introduced by using a window function to synthesize a sinusoid.

In accordance with an aspect of the invention, amplitude matching and phase matching are assured at the boundary of adjacent frames by properly controlling the amplitude and phase of each sinusoid in a frame.

In an embodiment, to assure amplitude matching, each sinusoid in a particular frame is synthesized such that its amplitude at the end time $t_e$ matches the amplitude of a corresponding sinusoid at the start time $t_s$ of the immediately succeeding frame. Similarly, each sinusoid in a particular frame is synthesized such that its amplitude at the start time $t_e$ matches the amplitude of a corresponding sinusoid at the end time $t_s$ of the immediately preceding frame. In an embodiment, these conditions can be achieved by synthesizing each sinusoid with amplitude that varies linearly (if at all) across the frame. Thus, the amplitudes at the start time $t_s$ and end time $t_e$ of the frame can be set to the desired values. In an embodiment, if a new sinusoid at a new frequency is added to a frame, it is "turned on" in a preceding frame by linearly varying the amplitude of this sinusoid from zero to the desired amplitude value. Similarly, if a sinusoid is removed from a frame, it is "turned off" in a succeeding frame by linearly varying the amplitude from the current amplitude value to zero.

In an embodiment, to assure phase matching, each sinusoid in a particular frame is synthesized such that its phase at the center of the frame results in a phase match at the frame boundary. For a sinusoid having a frequency of $b_o$, the phase varies linearly across the frame, with the magnitude of the variation being directly dependent on the frequency $b_o$. The amount of phase variation $\phi$ between the center of the frame to the end of the frame (i.e., either the start time $t_s$ or the end time $t_e$) can be computed as:

$$\phi = \frac{(N-2D)\pi b_o}{SN}. \qquad \text{Eq. (13)}$$

To assure phase matching, the phase at the center of the frame is selected such that the following condition is satisfied:

$$\phi_2 = \phi_1 + \frac{(N-2D)\pi b_1}{SN} + \frac{(N-2D)\pi b_2}{SN}, \qquad \text{Eq. (14)}$$

where $\phi_2$ is the phase at the center of the current frame, $\phi_1$ is the phase at the center of the immediately preceding frame, and $b_1$ and $b_2$ are the frequencies of the pair of corresponding sinusoids in the preceding and current frames, respectively. The factor $\pi b/SN$ is computed in equation (4) during the synthesis of the sinusoid in the frame.

Figure 4:
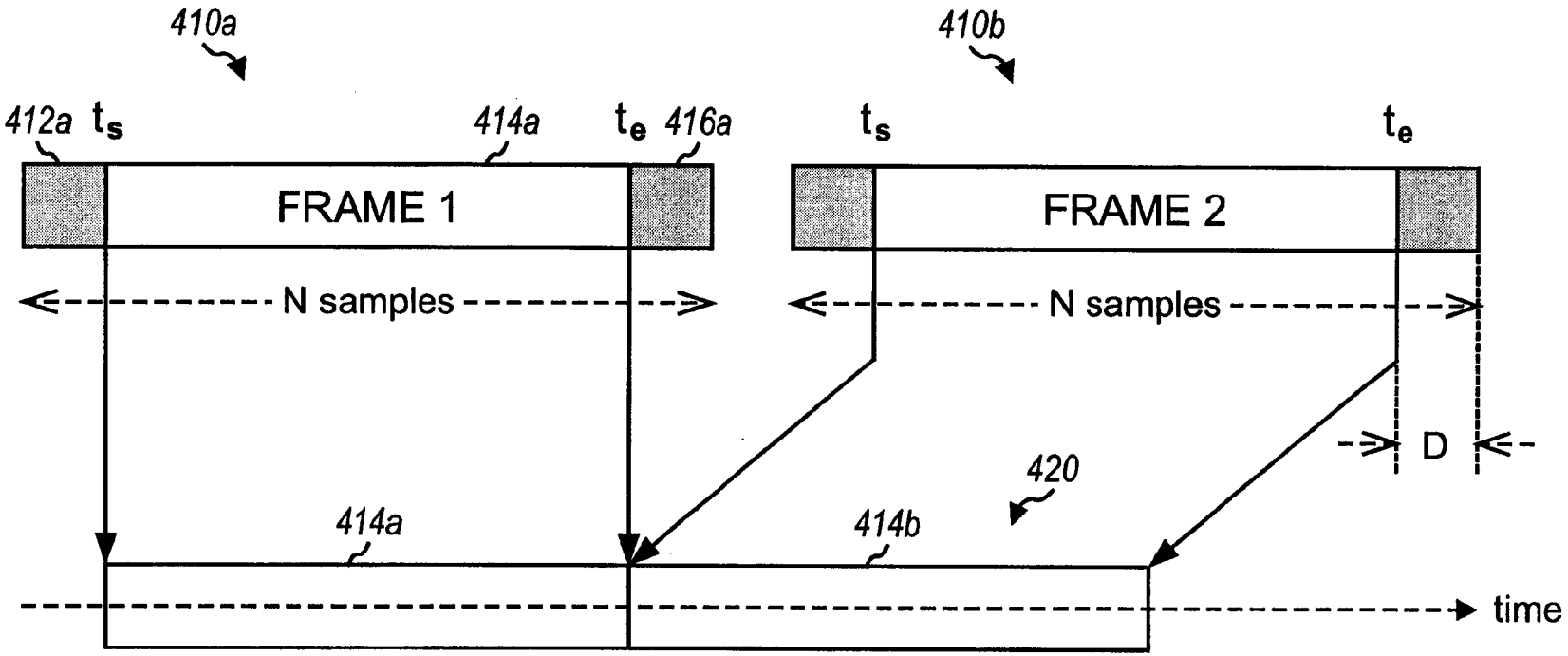
FIG. 4 shows a diagram that illustrates the concatenation of two frames in accordance with an aspect of the invention.

FIG. 4 shows a diagram that illustrates the concatenation of two time-domain frames in accordance with an aspect of the invention. A first time-domain frame 410*a* and a second time-domain frame 410*b*, each having N samples, are synthesized in the manner described above. Each frame 410 includes a left end portion 412, a center portion 414, and a right end portion 416. The center portion includes samples from a start time $t_s$ to an end time $t_e$. For each frame, the left and right end portions are discarded. The center portions of the time-domain frames are concatenated together to form an output signal 420.

Figure 5:
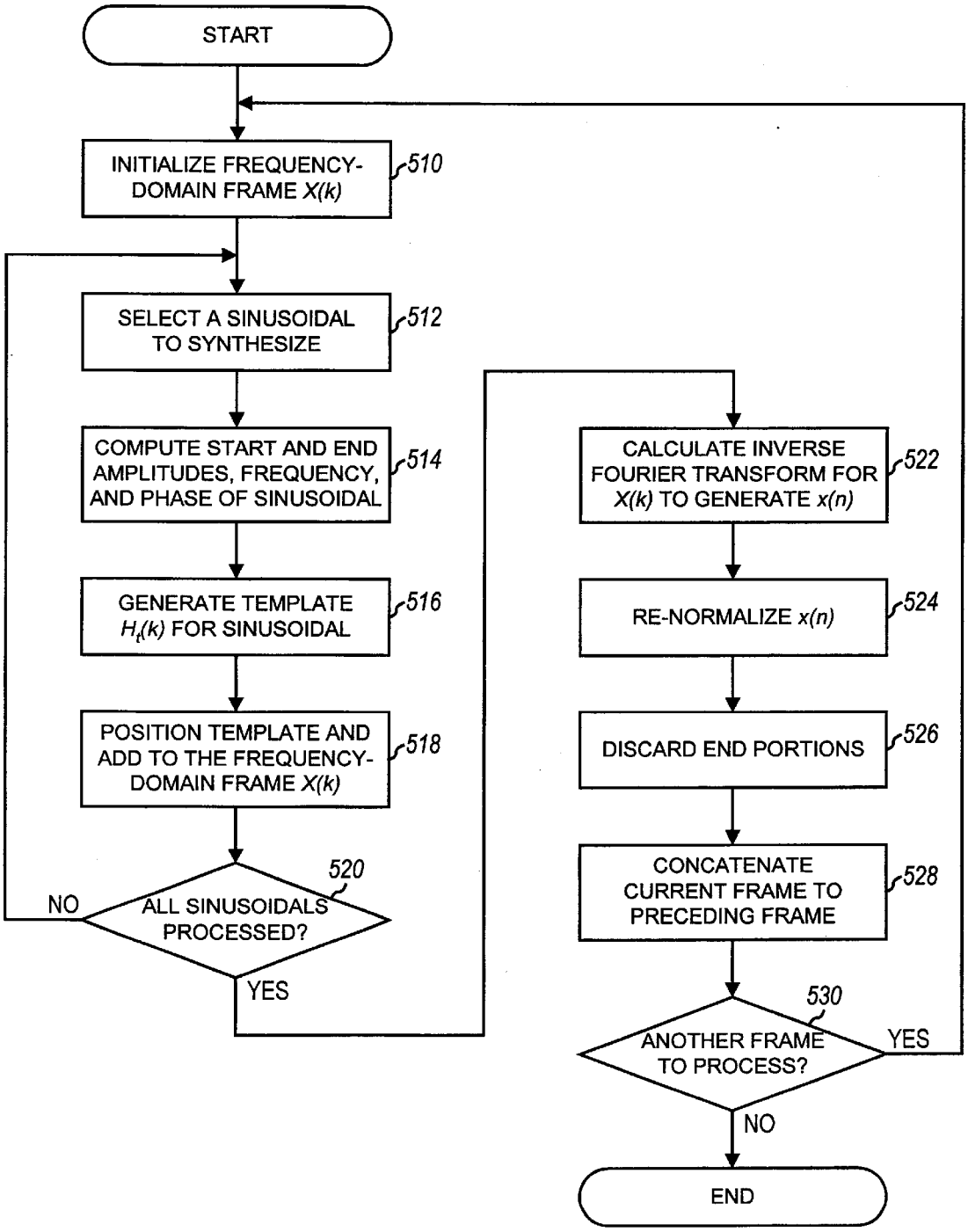
FIG. 5 shows a flow diagram of an embodiment of the synthesis process of the invention.

FIG. 5 shows a flow diagram of an embodiment of the synthesis process of the invention. The synthesis of a frame starts at a step 510 in which the frequency-domain frame X(k) is initialized by setting all bins to zero. At a step 512, a sinusoid is selected for synthesis. For the selected sinusoid, the start amplitude, end amplitude, frequency, and phase parameters are computed as described above, at a step 514. Using the parameters computed at step 514, the template $H_t(k)$ for the selected sinusoid is generated, at a step 516. The template is positioned at the frequency of the selected sinusoid and added to the frequency-domain frame X(k) using either equation (9) or (10), at a step 518.

At a step 520, a determination is made whether all sinusoids in the current frame have been processed (i.e., synthesized). If the answer is no, the process returns to step 512 and another sinusoid is selected for synthesis. Otherwise, the process continues to a step 522 in which an inverse Fourier transform is calculated for X(k) to generate a time-domain frame x(n). The time-domain frame x(n) is then re-normalized as described above with the inverse window function g(n), at a step 524. The end portions of the time-domain frame x(n) is discarded, at a step 526, and the non-discarded portion of the current time-domain frame is concatenated to the non-discarded portion of the preceding time-domain frame, at a step 528. At a step 530, a determination is made whether another frame needs to be synthesized. If the answer is yes, the process returns to step 510. Otherwise, the process ends.

As described above, the spectral pattern H(k) is oversampled by a factor of S to provide higher frequency resolution. This oversampling provides sampled values at "quantized" frequency bins. In an embodiment, interpolation can be used to further increase frequency resolution, decrease the amount of required storage, or both. For example, the spectral pattern can be calculated at the normal sampling rate (e.g., with S=1) and shifted to an arbitrary frequency using linear interpolation or any other kind of interpolation. For a linear interpolator, the interpolated sample Y(x) between calculated samples Y(0) and Y(1) can be computed as:

$$Y(x) = Y(0)\frac{d-x}{d} + Y(1)\frac{x}{d}, \qquad \text{Eq. (15)}$$

where x is the distance (in frequency) between samples Y(x) and Y(0) and d is the distance between samples Y(1) and Y(0). Interpolation of data samples are known in the art and not described in detail herein. Interpolation can be used independently of oversampling, i.e., interpolation can be used with any oversampling ratio.

As described above, for ease of implementation, the sinusoids are synthesized having amplitude and phase that vary linearly across the frame. However, these conditions are not required by the invention to maintain amplitude and phase continuities at the frame boundaries. Amplitude continuity can be maintained, for example, by summing the amplitudes of all sinusoids at the end time $t_e$ of one frame, and matching this with the sum of the amplitudes of all sinusoids at the start time $t_s$ of the immediately succeeding frame. Similarly, phase continuity can be maintained.

Accordingly, the template $H_t(k)$ may be calculated in a different manner than that shown in equation (7), and may not include the H'(k) term. For example, $H_t(k)$ can include only constant amplitude sinusoids plus an additional sinusoid having varying amplitude and phase that match the amplitude and phase of the waveforms at the frame boundaries. This additional sinusoid can be a sweep sinusoid having a frequency that varies (i.e., linearly) across the frame. Other methods to tabulate and match amplitude and phase between adjacent frames can be contemplated and are within the scope of the invention.

The invention can be implemented in various manners. For example, the invention can be implemented using software codes executed on a processor, such as processor 114 shown in FIG. 1. The invention can also be implemented in hardware within a digital signal processor (DSP), an application specific integrated circuit (ASIC), a controller, a processor, or other circuits designed to perform the functions described herein. For example, the invention can be implemented within an audio processor IC capable of synthesizing audio signals.

The previous description of the specific embodiments is provided to enable any person skilled in the art to make or use the invention. The various modifications to these embodiments will be readily apparent to those skilled in the art, and the generic principles defined herein may be applied to other embodiments without the use of the inventive faculty. For example, the techniques described above can be applied to the synthesis of video signals and other test signals. Thus, the invention is not intended to be limited to the embodiments shown herein but is to be accorded the widest scope consistent with the principles and novel features disclosed herein, and as defined by the following claims.

What is claimed is:

1. A method for synthesizing a time-domain signal comprising:

partitioning the time-domain signal into a plurality of time-domain frames;

generating a waveform for each of the plurality of time-domain frames, wherein each waveform includes one or more sinusoids, and wherein the generating a waveform includes selecting a sinusoid to synthesize, computing a set of parameter values for the selected sinusoid, determining a frequency-domain template for the selected sinusoid, wherein the frequency-domain template is based on the computed parameter values and a selected window function, and wherein the determined frequency-domain template is such that an amplitude of the selected sinusoid in the time-domain matches, at a time-domain frame boundary, an amplitude of a sinusoid, corresponding to the selected sinusoid, in an adjacent time-domain frame, adding the frequency-domain template to a frequency-domain frame, and transforming the frequency-domain frame to a time-domain frame, wherein the waveform is defined by the time-domain frame; and generating the time-domain signal using waveforms from the plurality of time-domain frames.

2. The method of claim 1 wherein the generating a waveform further includes repeating the selecting, computing, determining, and adding for each of the one or more sinusoids in the waveform.

3. The method of claim 1 wherein the generating the time-domain signal includes concatenating the waveforms from the plurality of time-domain frames.

4. The method of claim 1 wherein the generating a waveform further includes discarding a predetermined number of samples from each end of the time-domain frame, wherein the waveform is defined by non-discarded samples in the time-domain frame.

5. The method of claim 1 wherein the generating a waveform further includes re-normalizing the time-domain frame with a re-normalization function generated based on the selected window function.

6. The method of claim 1 wherein the template includes a first component corresponding to a sinusoid having constant amplitude.

7. The method of claim 6 wherein the template further includes a second component corresponding to a sinusoid having linearly varying amplitude.

8. The method of claim 7 wherein the second component is based on a derivative of the selected window function.

9. The method of claim 7 wherein the first and second components are precomputed for the selected window function and stored in a memory.

10. The method of claim 1 wherein the selected window function is selected from the set consisting of Hanning, Hamming, Kaiser, Gaussian, Dolph-Tchebyshev, Kaiser-Bessel, Blackman-Harris, triangular, and rectangular window functions.

11. The method of claim 1 wherein the selected window function is oversampled by an oversampling factor of S, where S is greater than one.

12. The method of claim 11 wherein S is a power of two.

13. The method of claim 1 wherein the set of parameter values includes start amplitude, end amplitude, frequency, and phase values.

14. The method of claim 1 wherein the set of parameter values is selected to match amplitude of pairs of corresponding sinusoids in adjacent time-domain frames.

15. The method of claim 1 wherein the set of parameter values is selected to match phase of pairs of corresponding sinusoids in adjacent time-domain frames.

16. The method of claim 1 wherein each of the one or more sinusoids in a particular waveform is turned on in a prior time-domain frame.

17. The method of claim 1 wherein each of the one or more sinusoids in a particular waveform is turned off in a subsequent time-domain frame.

18. The method of claim 1 wherein the adding includes translating the template to a frequency bin in the frequency-domain frame that most closely approximates a particular frequency of the selected sinusoid.

19. The method of claim 18 wherein the translating includes offsetting the template to account for difference between the particular frequency of the selected sinusoid and the approximated frequency bin.

20. The method of claim 18 wherein the translating includes interpolating samples in the template based, in part, on the particular frequency of the selected sinusoid.

21. The method of claim 20 wherein the interpolating is performed using a linear interpolator.

22. The method of claim 1 wherein the transforming is performed using a fast Fourier transform.

23. A computer program product for synthesizing a time-domain signal comprising:

an electronic storage unit encoded with code configured to partition the time-domain signal into a plurality of time-domain frames;

code configured to generate a waveform for each of the plurality of time-domain frames, wherein each waveform includes one or more sinusoids, and wherein the code configured to generate a waveform select a sinusoid to synthesize, compute a set of parameter values for the selected sinusoid, determine a frequency-domain template for the selected sinusoid, wherein the frequency-domain template is based on the computed parameter values and a selected window function, and wherein the determined frequency-domain template is such that an amplitude of the selected sinusoid in the time-domain matches, at a time-domain frame boundary, an amplitude of a sinusoid, corresponding to the selected sinusoid, in an adjacent time-domain frame, add the frequency-domain template to a frequency-domain frame, and transform the frequency-domain frame to a time-domain frame, wherein the waveform is defined by the time-domain frame; and code configured to generate the time-domain signal using waveforms from the plurality of time-domain frames.

24. The product of claim 23 wherein the code configured to generate a waveform further repeat the select, compute, determine, and add for each of the one or more sinusoids in the waveform.

25. The product of claim 23 wherein the code configured to generate the time-domain signal concatenates the waveforms from the plurality of time-domain frames.

26. The product of claim 23 wherein the code configured to generate a waveform further discard a predetermined number of samples from each end of the time-domain frame, wherein the waveform is defined by non-discarded samples in the time-domain frame.

27. The product of claim 23 wherein the code configured to generate a waveform further re-normalize the time-domain frame with a re-normalization function generated based on the selected window function.

28. A signal synthesizer comprising:

an electronic storage unit configured to store values of a spectral pattern corresponding to a sinusoid;

a processor coupled to the electronic storage unit, the processor configured to generate a sequence of waveforms, each waveform corresponding to a time-domain frame and including one or more sinusoids, wherein each time-domain frame is synthesized by:

determining a frequency-domain template for each of the one or more sinusoids, wherein each determined frequency-domain template is such that an amplitude of the sinusoid in the time-domain matches, at a time-domain frame boundary, an amplitude of a corresponding sinusoid in an adjacent time-domain frame, adding the frequency-domain templates to generate a frequency-domain frame, and transforming the frequency-domain frame to the time-domain.

* * * * *

UNITED STATES PATENT AND TRADEMARK OFFICE

CERTIFICATE OF CORRECTION

PATENT NO. : 6,311,158 B1
DATED : October 30, 2001
INVENTOR(S) : Jean Laroche

It is certified that error appears in the above-identified patent and that said Letters Patent is hereby corrected as shown below:

Title page,
Please correct the title to read as follows
-- TRANSFORM SYNTHESIS OF TIME-DOMAIN SIGNALS USING CONCATENATED NON-OVERLAPPING FRAMES --

Signed and Sealed this

Twenty-first Day of May, 2002

*Attest:*

*Attesting Officer*

JAMES E. ROGAN
*Director of the United States Patent and Trademark Office*